US006571591B2

(12) United States Patent
Itaya

(10) Patent No.: US 6,571,591 B2
(45) Date of Patent: Jun. 3, 2003

(54) SPRING MANUFACTURING APPARATUS AND WIRE GUIDE USED FOR THE SAME

(75) Inventor: Ichiro Itaya, Tokyo (JP)

(73) Assignee: Kabushiki Kaisha Itaya Seisaku Shu, Tokyo (JP)

( * ) Notice: Subject to any disclaimer, the term of this patent is extended or adjusted under 35 U.S.C. 154(b) by 0 days.

(21) Appl. No.: 09/904,470

(22) Filed: Jul. 13, 2001

(65) Prior Publication Data

US 2002/0108419 A1 Aug. 15, 2002

(30) Foreign Application Priority Data

Feb. 14, 2001 (JP) ..... 2001-037228

(51) Int. Cl.[7] ..... B21F 35/02
(52) U.S. Cl. ..... 72/137; 72/135
(58) Field of Search ..... 72/135, 136, 137, 72/138, 403, 404, 441, 442

(56) References Cited

U.S. PATENT DOCUMENTS 642,339 A * 1/1900 Krummel ..... 72/138
2,134,469 A * 10/1938 Bergevin ..... 140/103
3,402,584 A * 9/1968 Cavagnero ..... 72/137
6,142,002 A * 11/2000 Itaya ..... 72/137
6,151,942 A * 11/2000 Itaya ..... 72/137

* cited by examiner

*Primary Examiner*—Allen Ostrager
*Assistant Examiner*—John S. Goetz
(74) *Attorney, Agent, or Firm*—Merchant & Gould P.C.

(57) ABSTRACT

A wire feeder (300) includes a cross table (302) placed to be movable in the back-and-forth direction along a wire feed direction (D), and upper and lower tables (304, 305) which can move in the up-and-down direction along a direction perpendicular to the wire feed direction with respect to the cross table (302). Feed rollers (320, 321) for feeding a wire are rotatably mounted on the upper and lower tables (304, 305). A wire guide (330) integrally formed from upstream to downstream along the wire feed direction (D) with respect to the feed rollers (320, 321) is placed, together with the feed rollers (320, 321), on a wire axis extending from the cross table 302 to the upper and lower tables (304, 305) to be movable in the back-and-forth direction and up-and-down direction.

4 Claims, 8 Drawing Sheets

SPRING MANUFACTURING APPARATUS AND WIRE GUIDE USED FOR THE SAME

FIELD OF THE INVENTION

The present invention relates to a spring manufacturing apparatus and to a wire guide used for the apparatus and, more particularly, to a spring manufacturing apparatus for manufacturing a spring by forcibly bending, curving, or winding a wire to be formed into a spring in a spring forming space near the distal end of a wire guide with a tool while continuously feeding the wire.

BACKGROUND OF THE INVENTION

In a conventional spring manufacturing apparatus, a pair of feed rollers for feeding a wire are fixed, and a cutting tool for cutting the wire in cooperation with a mandrel is slidably mounted in the vertical direction. The distance between the rotation center of the feed rollers and the cutting tool is constant owing to the structure of the apparatus, and the length of a wire guide for feeding a wire is also constant.

In the conventional spring manufacturing apparatus, no problem arises even if there is a slight space between the wire guide and the feed rollers or between the wire guide, the mandrel, and the tool as long as the diameter of a wire is 1 mm or more. In forming a very thin wire with a diameter of 100 $\mu$m or less, however, the wire protrudes from this slight space, and hence the wire guide must be accurately manufactured so as not to form such a space. In addition, as shown in FIG. 8, if a wire guide is divided in the wire feed direction, the distance from the inlet side to the outlet side of the wire guide or from the feed rollers to the tool increases, and wire insertion holes formed through the wire guides must be accurately aligned with each other.

SUMMARY OF THE INVENTION

The present invention has been made in consideration of the above problem, and has as its object to provide a spring manufacturing apparatus which can easily adjust the positional relationship between the feed direction of a wire fed from a wire guide and a tool.

In order to solve the above problem and achieve the above object, according to the present invention, there is provided a spring manufacturing apparatus which has wire feed means for feeding a wire to be formed into a spring from an end portion of a wire guide toward a spring forming space, and tool means placed to retractably move into the spring forming space, and which manufactures a spring by forcibly bending, curving, or winding the wire with the tool means while feeding the wire from the wire feed means into the spring forming space near the distal end portion of the wire guide, wherein the wire feed means is supported to allow a position of the wire feed means relative to the tool means to-be variable. Since the wire feed means is supported to make the position of the wire feed means relative to the tool become variable, the positional relationship between the feed direction of a wire-fed from the wire feed means and the tool can be easily adjusted.

Furthermore, the wire glide is integrally formed in the wire feed direction. As a result, protrusion of a wire can be prevented, the structure of the guide is simplified, and mounting of the wire is facilitated.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

Figure 1:
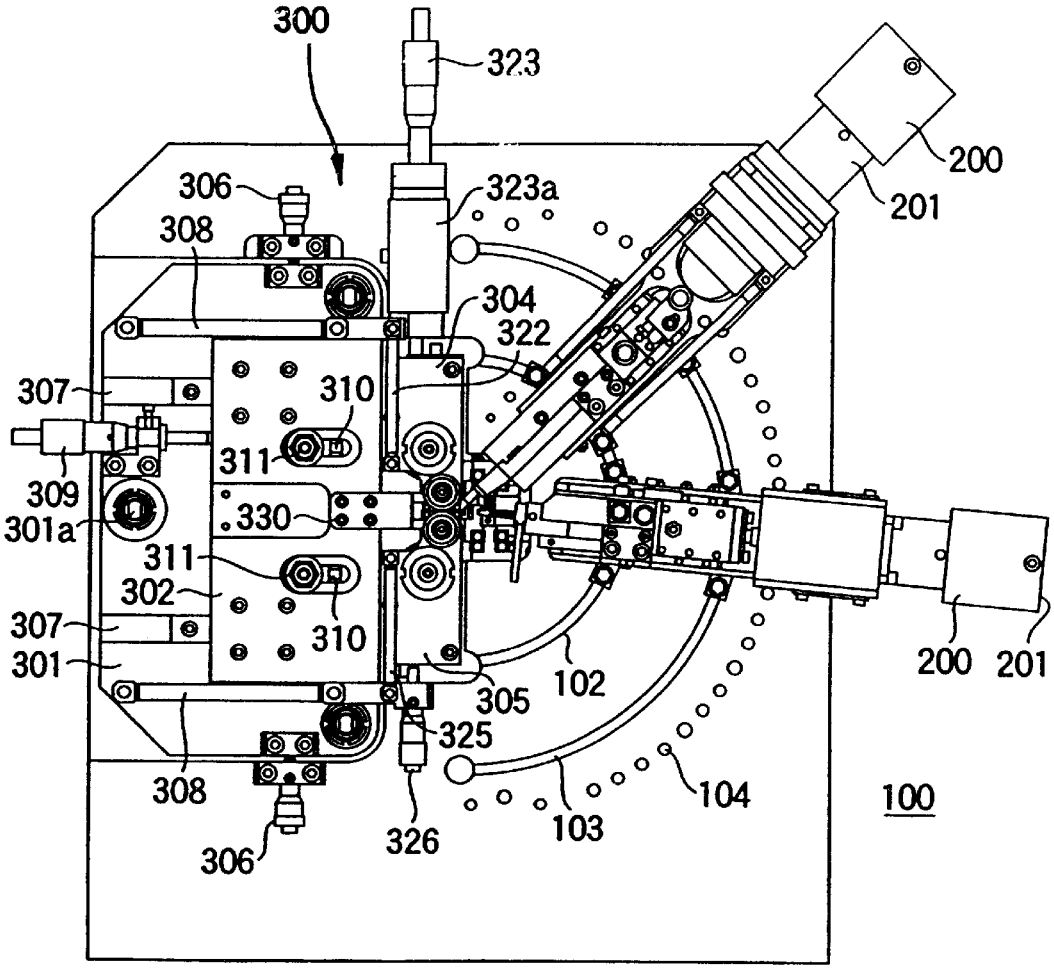
FIG. 1 is a front view of a spring manufacturing apparatus according to an embodiment of the present invention.
Figure 2:
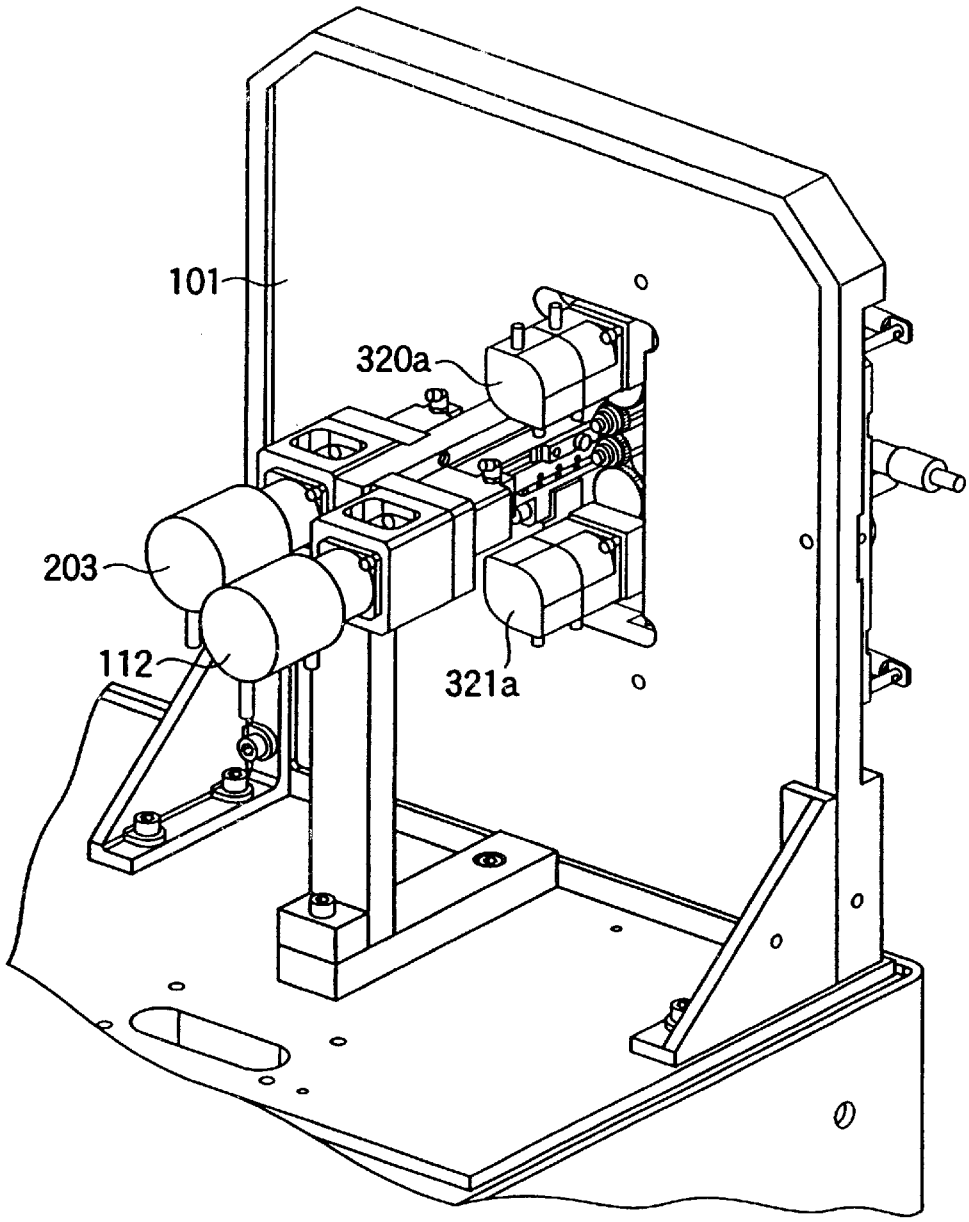
FIG. 2 is a rear perspective view of the apparatus in FIG. 1.
Figure 3:
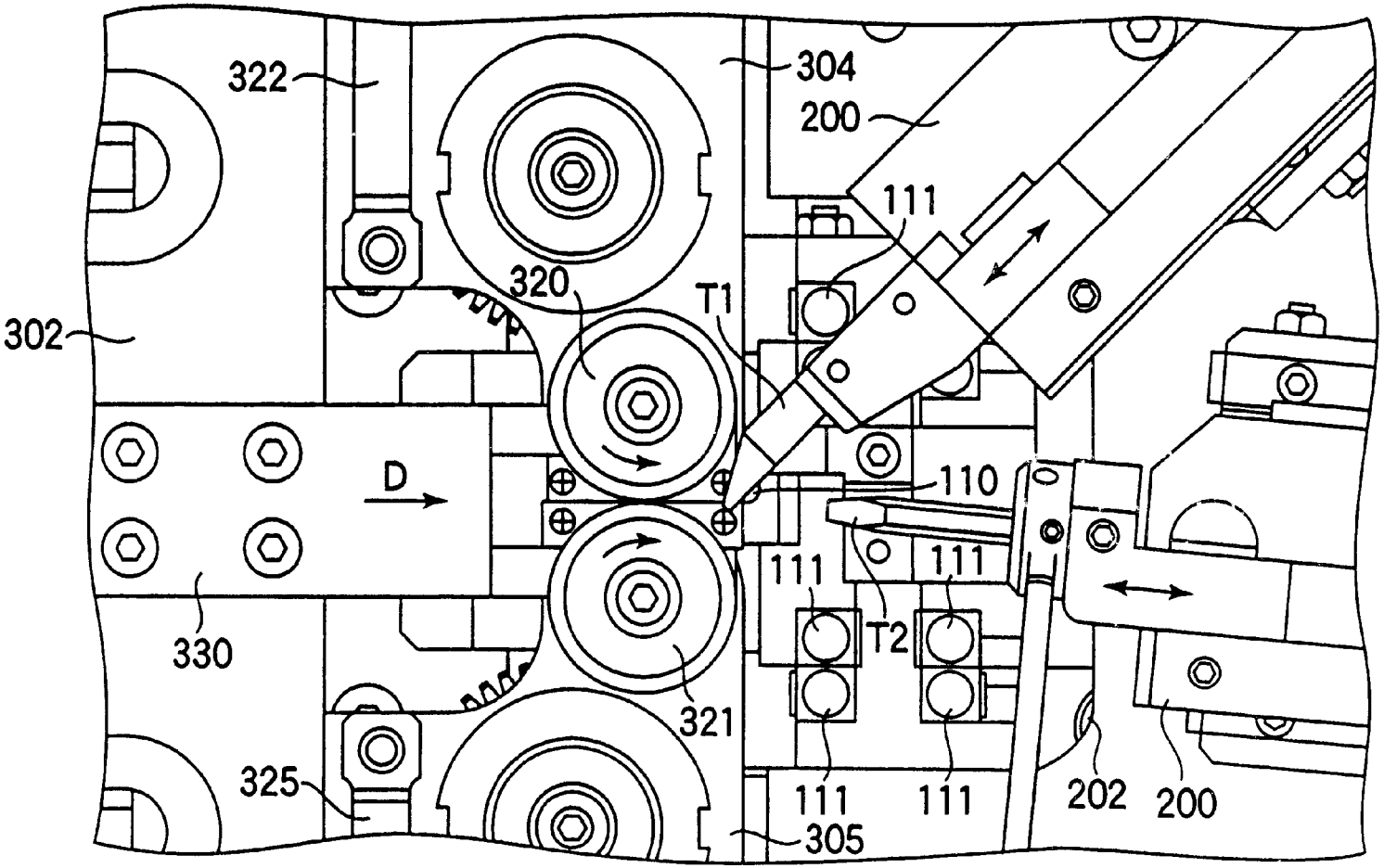
FIG. 3 is a view showing the details of a spring forming space in the spring manufacturing apparatus according to this embodiment.
Figure 4:
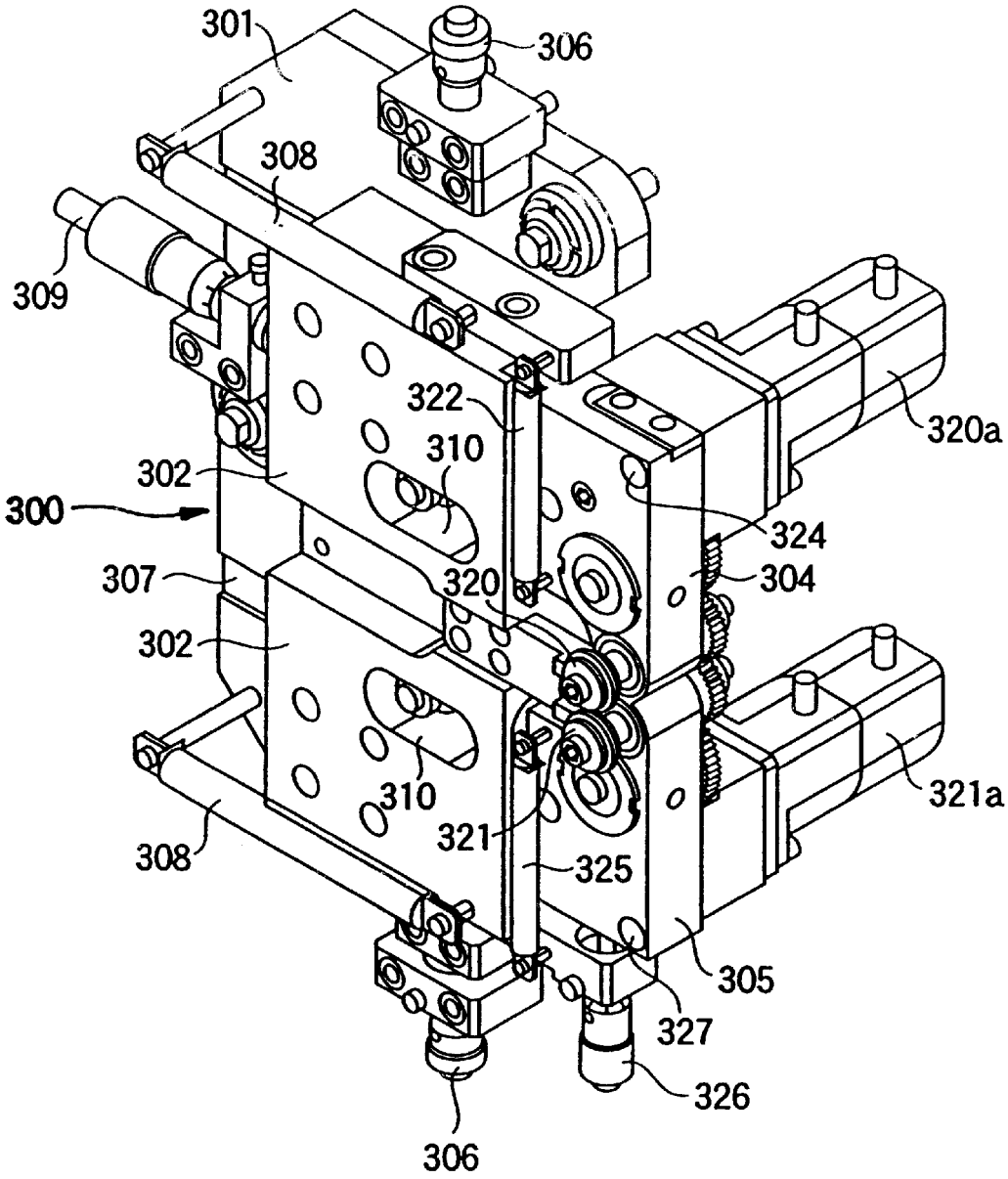
FIG. 4 is a schematic perspective view of a wire feeder.
Figure 5:
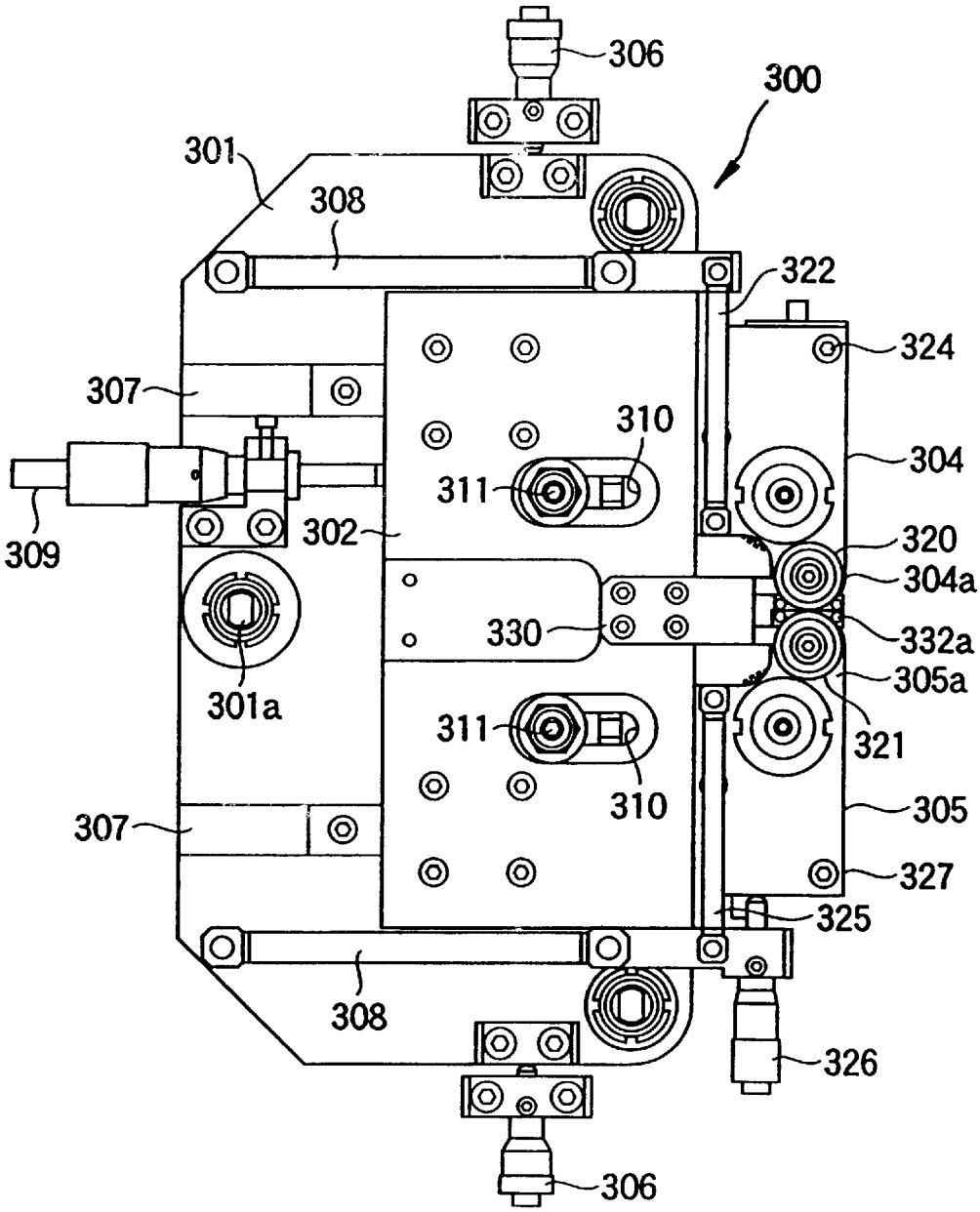
FIG. 5 is a front view of the device in FIG. 4.

An embodiment of the present invention will be described in detail below with reference to the accompanying drawings.

The embodiment described below is an example of a means for implementing the present invention. The embodiment can be modified or changed without departing from the spirit and scope of the invention.

In the following description, the terms and operations of the respective elements are defined while a direction parallel to a wire feed direction D is defined as a back-and-forth direction or lateral direction, and a direction perpendicular to the wire feed direction D is defined as an up-and-down direction.

As shown in FIGS. 1 to 5, a spring manufacturing apparatus 100 of this embodiment is used to form, in particular, a spring from a very thin wire with a diameter of 100 $\mu$m or less, and preferably, 0.2 to 0.02 mm.

This spring manufacturing apparatus 100 includes a rectangular main table 101 mounted on a box-like base (not shown), a tool unit 200 placed on the main table 101, and a movable wire feeder 300 placed to face the tool unit 200.

A semicircular inner circumferential groove 102 is formed in one of the surfaces of left and right sides of a substantially middle portion of the main table 101. An outer circumferential groove 103 is formed outside the inner circumferential groove 102. A plurality of fixed holes 104 are also formed outside the outer circumferential groove 103 therealong in the form of a semicircle.

The tool unit 200 can move along the inner circumferential groove 102 and outer circumferential groove 103. In addition, the amplitude of each tool in the spring forming space can be changed by setting the tool at an angle corresponding to a desired spring shape and fixing it in the fixed hole 104 formed in the main table 101 with a bolt.

A tool driving motor 201 is mounted in each tool unit 200, and each tool unit can be detachably mounted on the main table 101. A tool T1 is placed at an angle at which no load is imposed on a mandrel 110 (to be described later), and serves as a cutting tool for cutting a wire in cooperation with the mandrel 110. A tool T2 is a point tool for forming a coil portion by coming into contact with a wire to wind it.

Obviously, tool types, positions, and the like can be arbitrarily set. As the tool units 200, tools other than the above tools, e.g., a bending tool, holding tool, and the like having different shapes can also be mounted.

On the other of the surfaces of left and right sides of a substantially middle portion of the main table 101, the wire feeder 300 is mounted to be movable by predetermined distances in the back-and-forth direction and up-and-down direction.

The wire feeder 300 is comprised of a base table 301 which rotates through a predetermined angle about a rotating shaft 301*a* mounted on the main table 101 and whose position relative to the main table 101 can be adjusted by using a micrometer 306, a cross table 302 which is mounted on the base table 301 to be movable along the wire feed direction D, and elevating tables 304 and 305 which can move in the up-and-down direction along a direction perpendicular (or at an arbitrary angle) to the wire feed direction D with respect to the cross table 302.

The cross table 302 is vertically symmetrical about the wire axis, and the elevating tables 304 and 305 are separated into upper and lower tables 304 and 305 which are vertically symmetrical about the wire axis.

The cross table 302 can slide along two parallel grooves 307 which are formed parallel to the wire feed direction D at equal distances from the wire axis vertically and spaced apart from each other. The cross table 302 is mounted on the base table 301 while its upper and lower side portions are biased in the opposite direction to the wire feed direction D with springs 308 and the like. One end portion of each spring 308 is locked to the base table 301, and the other end portion is locked to a corresponding one of the upper and lower side portions of the cross table 302, thereby biasing the cross table 302 in the opposite direction to the wire feed direction D. A micrometer 309 is placed in contact with the rear side portion of the cross table 302. The micrometer 309 can finely adjust the moving amount of the cross table 302 by moving it in the wire feed direction D against the biasing force of the springs 308.

The moving amount of the cross table 302 in the back-and-forth direction is, for example, about 20 mm, and defined by the length of elliptic holes 310 formed in the cross table 302 at equal distances from the wire feed direction D in the vertical direction. Bolt shafts 311 protruding from the base table 301 extend through the elliptic holes 310. The cross table 302 is fixed on the base table 301 by fastening the bolt shafts 311 with nuts and the like after a moving amount in the back-and-forth direction is set by the micrometer 309.

The upper table 304 is mounted on the cross table 302 to be movable in the up-and-down direction with respect to the cross table 302 while being biased in a direction (upward) to separate from the wire axis with a spring 322 locked to the upper end portion of the base table 301 and the lower side portion of the upper table 304. The moving amount (e.g., about 10 mm) of the upper table 304 in the up-and-down direction can be finely adjusted by a micrometer 323. The upper table 304 is fixed on the base table 301 with a bolt 324 and the like after being pressed against the lower table 305 in the wire axis direction (downward) with a spring 323*a* and the like and positioned.

The lower table 305 is mounted on the cross table 302 to be movable in the up-and-down direction while being biased in a direction to separate from the wire axis (downward) with a spring 325 locked to the lower end portion of the base table 301 and the upper side portion of the lower table 305. The moving amount (e.g., about 10 mm) of the lower table 305 in the up-and-down direction can be finely adjusted by a micrometer 326. The lower table 305 is fixed on the elliptic hole 310 with a bolt 327 and the like to receive the pressure of the upper table 304.

Protruding portions 304*a* and 305*a* protrude from the upper and lower tables 304 and 305 toward the wire axis. Feed rollers 320 and 321 for clamping and feeding a wire are rotatably mounted on the protruding portions 304*a* and 305*a,* respectively. The feed rollers 320 and 321 are independently rotated/driven by servo motors 320*a* and 321*a* respectively mounted on the upper and lower tables 304 and 305. The upper and lower tables 304 and 305 have the same arrangement and are arranged such that the feed rollers 320 and 321 of the upper and lower tables 304 and 305 face each other and clamp a wire.

The upper table 304 is positioned by being pressed against the lower table 305 with a predetermined pressure to allow the pair of upper and lower feed rollers 320 and 321 to clamp a wire. In this state, the rollers are rotated/driven in the wire feed direction D to feed the wire in the spring forming space.

Since the feed rollers 320 and 321 are independently rotated/driven by the servo motors 320*a* and 321*a* respectively mounted on the upper and lower tables 304 and 305 in this manner, the driving mechanisms for the feed rollers can be simplified. As a consequence, the feed rollers can be driven/controlled with high precision.

More specifically, if a pair of feed rollers are to be driven by one servo motor, the respective rollers are driven by meshing gears and the like. Since the rollers must be moved while the gears are kept meshed with each other, it is difficult to vertically move each roller. It is therefore difficult to move each roller without changing the positional relationship between the wire guide and the rotation centers of the feed rollers.

In contrast to this, in this embodiment, since the upper and lower tables 304 and 305 can be moved in the up-and-down direction, the outer diameters of the feed rollers 320 and 321 can be changed. For example, a feed roller having an outer diameter of about 20 mm can be replaced with a feed roller having a larger or smaller outer diameter in accordance with a desired spring shape.

Even if two rollers slightly differ in their outer diameters as in a case where the peripheral portion of one feed roller which clamps a wire is made plane, and a groove is formed in the peripheral portion of the other feed roller, the wire feed speed can be uniformly controlled by slightly changing the rotational speed of each roller.

A wire guide 330 integrally formed from the upstream side to the downstream side in the wire feed direction D with respect to the feed rollers 320 and 321 is mounted op the cross table 302, and upper and lower tables 304 and 305 along the wire axis are movable together with the cross table 302 and upper and lower tables 304 and 305 in the back-and-forth direction and up-and-down direction.

Figure 6:
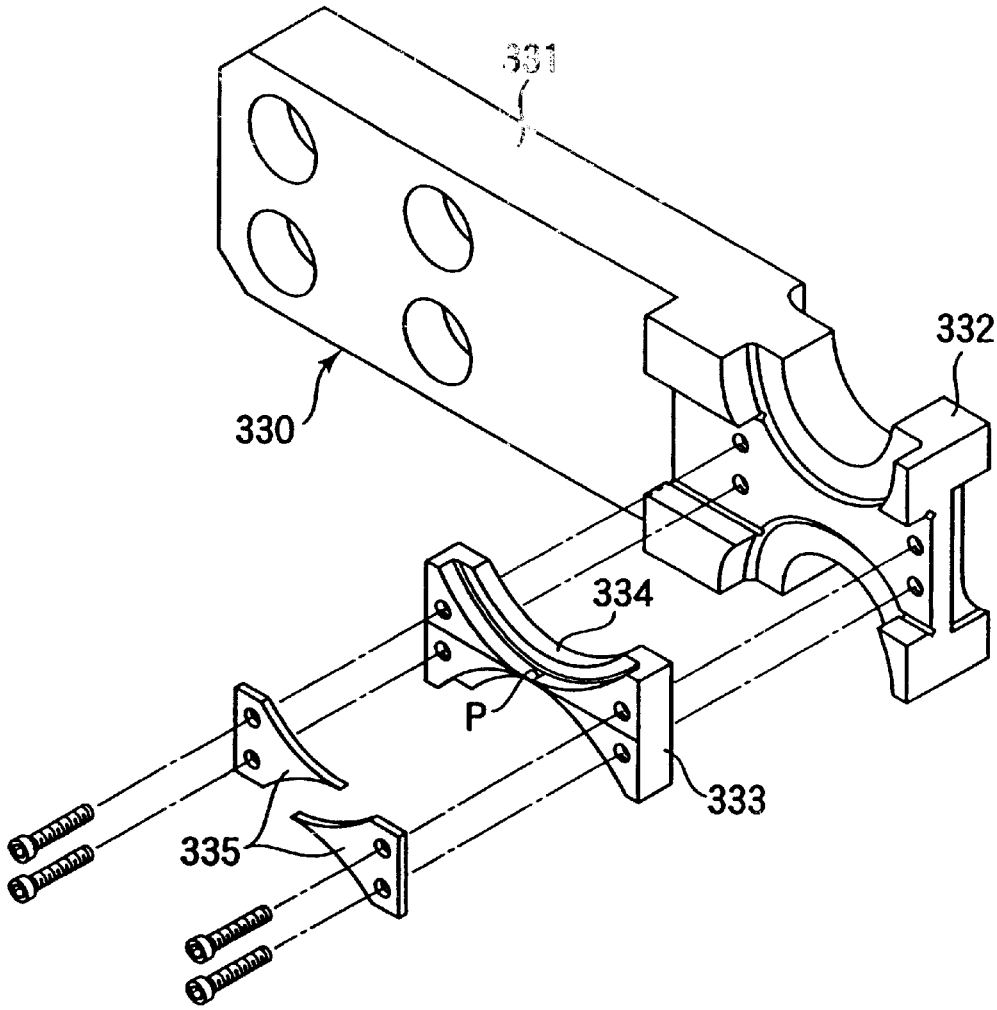
FIG. 6 is an exploded perspective view of a wire guide.

As shown in FIG. 6, the wire guide 330 is integrally formed to extend from the downstream side to the upstream side along the wire feed direction D, and has an upstream block 331 located upstream front the feed rollers 320 and 321 and a downstream block 332 continuously extending from the upstream block 331 to the downstream side of the, feed rollers 320 and 321.

A guide block 334 having a wire insertion hole (or groove) 333 through which a wire extends is mounted on the downstream block 332. The wire insertion hole 333 is formed along the wire feed direction D to have a width and depth that allow a wire having a diameter of 100 $\mu$m or less to extend therethrough.

The guide block 334 is mounted on a plurality of portions of the downstream block 332 with bolts and the like via rackets 335.

The downstream block 332 and the guide block 334 extend in the longitudinal, direction along the wire, feed direction D and are formed to be vertically symmetrical about the wire axis. Those portions of the downstream block 332 and the guide block 334 which correspond to the feed rollers 320 and 321 are cut along the circumferential shapes of the feed rollers 320 and 321 such that their circumferences come into contact with tech other. Near a contact point P between the circumferences of the feed rollers, a wire extends through the wire insertion hole 333 and is exposed vertically. The wire exposed from the wire insertion hold 333 is clamped between the pair of feed rollers 320 and 321 and fed into the spring forming space.

A downstream end portion 332*a* of the downstream block 332 is positioned by the cross table 302 and upper and lower tables 304 and 305 to be located near or in contact with the mandrel 110 placed in the spring forming space. The various tools T1 and T2 are placed to be slidable toward the mandrel 110. The mandrel 110 is formed into, for example, a semicircular shape and can move in the direction of the normal to the main table 101. The mandrel 110 is supported by cross roller guides 111 and the like to be movable in the direction of the normal to the table 101. The position at which the mandrel 110 protrudes with respect to the table 101 can be adjusted by a servo motor 112 and is used to bend and cut a wire in cooperation with the tools T1 and T2.

The tool unit 200 (or more than one), which form springs having desired shapes by forcibly bending, curving, winding, or cutting wires, radially extent toward the spring forming spaces while being arranged tote slidable along the wires fed into the spring forming spaces.

Each tool unit 200 is slid by a crank mechanism using a slide driving motor 201 such as a servo motor for converting a rotational motion into a translational motion as a driving source. In addition, if the tool unit 200 has a rotating tool that rotates about a tool shaft, a servo motor for rotating the tool shaft is added as a driving source.

Like the support structure for the mandrel 110, the point tool T2 is supported by a cross roller guide 202 to be movable in the direction of the normal to the table 101, and the position at which the tool protrudes with respect to the table 101 can be adjusted by a tool push driving motor 203 such as a servo motor.

In the above embodiment, since the feed rollers 320 and 321 and wire guide 330 can be moved in the directions parallel and perpendicular to the wire feed direction, the positional relationship between the wire feed direction of a wire fed from the wire guide 330 and the tool can be easily adjusted.

In addition, since the wire guide 330 is integrally formed in the wire feed direction and comes into contact with the mandrel 110, the distance from the rotation center of the feed rollers 320 and 321 to the downstream end portion 332*a* of the wire guide 330 decreases, and the protrusion of a wire is suppressed. This simplifies the structure of the wire guide and facilitates mounting of it.

[Arrangement of Control Circuit]

The arrangement of a control circuit for the spring manufacturing apparatus according to this embodiment will be described next.

Figure 7:
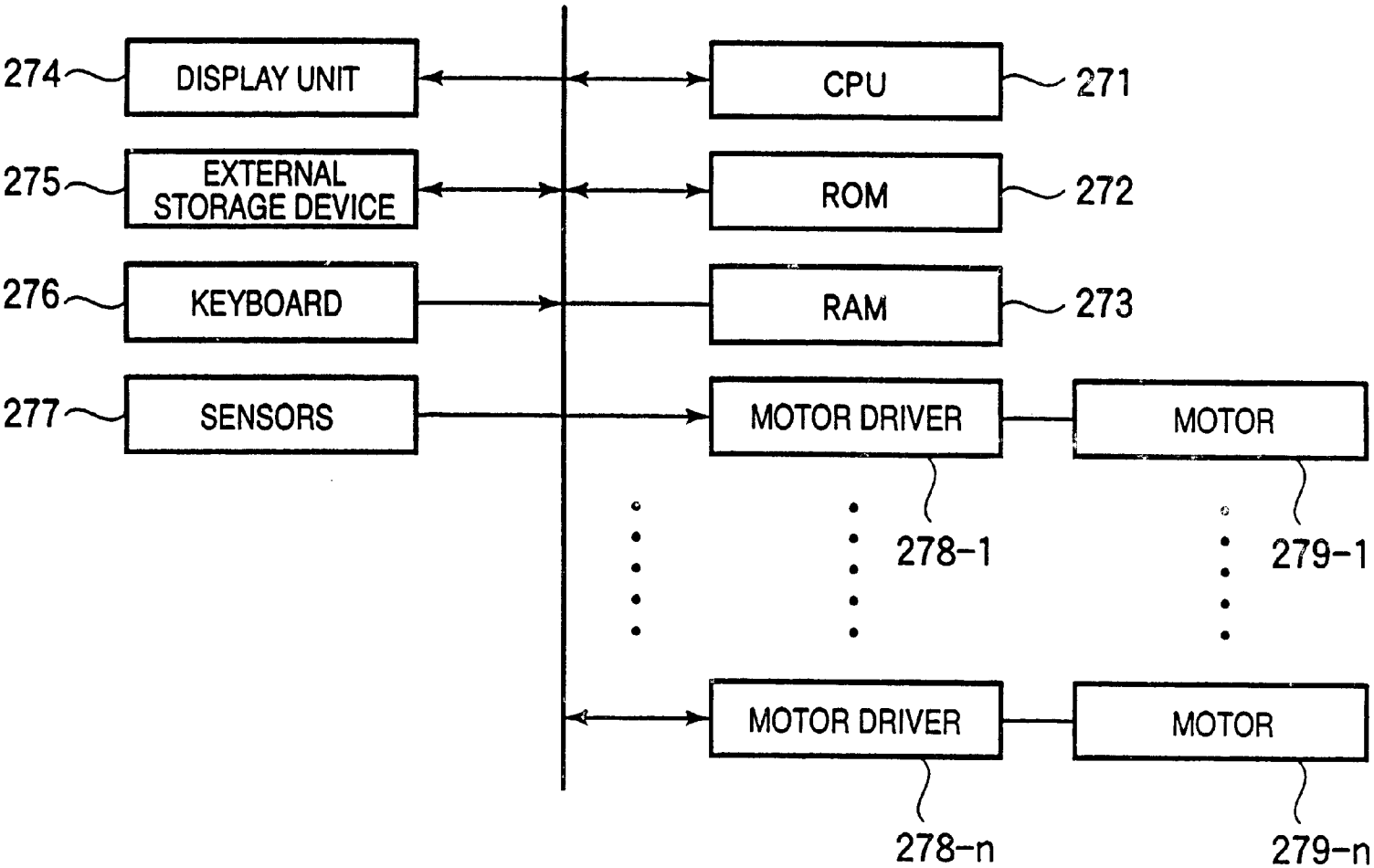
FIG. 7 is a block diagram showing the arrangement of a control circuit for the spring manufacturing apparatus according to this embodiment.
Figure 8:
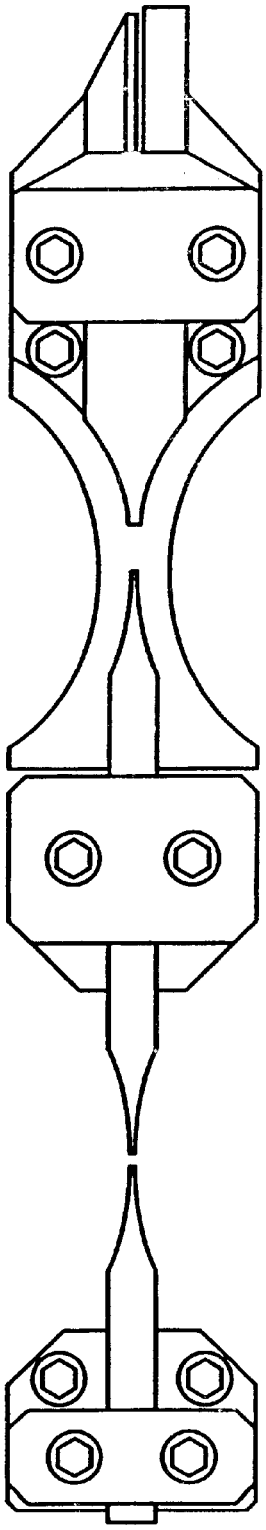
FIG. 8 (PRIOR ART)
FIG. 8 is a front view of a conventional wire guide.

FIG. 7 is a block diagram showing the arrangement of the control circuit for the spring manufacturing apparatus according to this embodiment.

As shown in FIG. 7, a CPU 271 controls the overall controller. A ROM 272 stores processing contents (programs) of the CPU 271 and the like. A RAM 273 is used as a work area of the CPU 271 and used to store the control program, position data, and the like downloaded from the ROM 272. A display unit 274 is a liquid crystal display or the like and used to perform various settings, display the contents of the settings, and also display a manufacturing process and the like in the form of graphs. An external storage device 275 is a floppy disk drive, CD-ROM driver, or the like and used to externally supply a program or store various setting contents for wire forming. With this arrangement, for example, by storing parameters for a given forming process (e.g., for a spring, its free length, diameter, and the like) in advance, springs having the same shape can always be manufactured by setting the floppy disk and executing the program.

A keyboard 276 is used to set various parameters. Sensors 277 are used to detect the feed amount of wire, the free length of a spring, and the like.

The above tool slide driving motor 201, tool push driving motor 203, feed roller driving motors 320*a* and 321*a*, and the mandrel driving motor 112 correspond to motors 279-1 to 279-n and are respectively driven by corresponding motor drivers 278-1 to 278-n.

In this control block, the CPU 271 independently drives the respective motors, input/output data to/from the external storage device 275, and controls the display unit 274 in accordance with instructions input through the keyboard 276.

The present invention is not limited to the above embodiments and various changes and modifications can be made within the spirit and scope of the present invention. Therefore, to apprise the public of the scope of the present invention the following claims are made.

What is claimed is:

1. A spring manufacturing apparatus forming a wire into a spring, comprising;

a main table:

a wire feeder mounted on said main table and forming a spring forming space, said wire feeder including a wire guide with an end portion; and a tool unit attached to said main table;

wherein said wire feeder feeds said wire from the end portion of said wire guide in a feed direction toward the spring forming space and said tool unit retractably moves into the spring forming space to forcibly bend, curve, or wind the wire into said spring; and wherein said wire feeder, is movable in the feed direction of the wire and in a direction perpendicular to the feed direction of the wire, said wire feeder including a base table being rotatable with respect to said main table, a cross table being movable along the feed direction of the wire with respect to the base table, and elevating tables being movable in the direction perpendicular to the feed direction of the wire with respect to the cross table.

2. The apparatus according to claim 1, wherein said wire feeder comprises a pair of toilers which rotate while clamping the wire, and roller driving units provided for each roller, said rollers and said roller driving units being supported, together with said wire guide, on said elevating tables.

3. The apparatus according to claim 1, wherein the wire has a diameter of not more than 100 $\mu$m.

4. The apparatus according to claim 1, wherein said wire guide is integrally formed in the feed direction of the wire.

* * * * *

UNITED STATES PATENT AND TRADEMARK OFFICE

CERTIFICATE OF CORRECTION

PATENT NO. : 6,571,591 B2
DATED : June 3, 2003
INVENTOR(S) : Itaya

It is certified that error appears in the above-identified patent and that said Letters Patent is hereby corrected as shown below:

Title page,
Item [73], Assignee, "Kabushiki Kaisha Itaya Seisaku Shu," should read
-- Kabushiki Kaisha Itaya Seisaku Sho, --

Signed and Sealed this

Twenty-sixth Day of July, 2005

JON W. DUDAS
*Director of the United States Patent and Trademark Office*